US006601531B1

(12) United States Patent
Baylot et al.

(10) Patent No.: US 6,601,531 B1
(45) Date of Patent: Aug. 5, 2003

(54) FLOATING SUPPORT INCLUDING A CENTRAL CAVITY COMPRISING A PLURALITY OF COMPARTMENTS

(75) Inventors: Michel Baylot, Marseilles (FR); Michel France Gassert, Saverne (FR); Xavier Rocher, Chatou (FR)

(73) Assignee: Bouygues Offshore, Montigny le Bretonneux (FR)

( * ) Notice: Subject to any disclaimer, the term of this patent is extended or adjusted under 35 U.S.C. 154(b) by 0 days.

(21) Appl. No.: 10/049,443

(22) PCT Filed: Aug. 3, 2000

(86) PCT No.: PCT/FR00/02243

§ 371 (c)(1),
(2), (4) Date: Mar. 5, 2002

(87) PCT Pub. No.: WO01/11183

PCT Pub. Date: Feb. 15, 2001

(30) Foreign Application Priority Data

Aug. 9, 1999 (FR) ..... 99 10418

(51) Int. Cl.[7] ..... B63B 35/44
(52) U.S. Cl. ..... 114/264
(58) Field of Search ..... 114/294, 264

(56) References Cited

U.S. PATENT DOCUMENTS

| | | | | |
|---|---|---|---|---|
| 2,999,549 A | | 9/1961 | Stratton | 175/5 |
| 3,717,002 A | | 2/1973 | O'Brien | 61/72.3 |
| 3,902,553 A | | 9/1975 | Jergins | 166/5 |
| 3,981,369 A | | 9/1976 | Bokenkamp | 175/5 |
| 4,044,895 A | * | 8/1977 | Adair | 414/22.63 |
| 4,505,614 A | | 3/1985 | Anschutz | 405/195 |
| 4,708,563 A | | 11/1987 | Van Den Berg | 414/22 |
| 5,486,070 A | | 1/1996 | Huete | 405/202 |

FOREIGN PATENT DOCUMENTS

| | | | |
|---|---|---|---|
| FR | 2 747 728 | 4/1996 | E21B/43/01 |
| FR | 2 754 011 | 9/1996 | E21B/17/01 |

OTHER PUBLICATIONS

International Search Report dated Aug. 3, 2002 (in French).

* cited by examiner

*Primary Examiner*—Jesus D. Sotelo
(74) *Attorney, Agent, or Firm*—Cohen, Pontani, Lieberman & Pavane

(57) ABSTRACT

The present invention relates to a floating support of the type having a cavity (1) within which a plurality of risers (2) can be positioned. According to the invention, the cavity (1) has a plurality of compartments (3) at the ends of which said risers (2) are in a production position (4), said compartments communicating with a central channel (5) at the end of which there is situated (6) a drilling derrick (7), said compartments being disposed transversely relative to said central channel (5).

23 Claims, 5 Drawing Sheets

FLOATING SUPPORT INCLUDING A CENTRAL CAVITY COMPRISING A PLURALITY OF COMPARTMENTS

PRIORITY CLAIM

This is a national stage of PCT application No. PCT/FR00/02243, filed on Aug. 3, 2000. Priority is claimed on that application, and on patent application No. 99/10418 filed in France on Aug. 9, 1999.

BACKGROUND OF THE INVENTION

The present invention relates in general to the field of bottom-to-surface type connections of the type including a vertical underwater pipe referred to as an up column or riser, connecting the sea bed to a floating support installed on the surface.

Once the depth of water becomes large, production fields and in particular oil fields are generally operated from floating supports. When operating an off-shore hydrocarbon deposit at great depth, it is preferable for economic reasons that the floating support structure be capable of performing all of the operations concerned with drilling wells, putting them into production, and reconditioning them. It is also preferable for the floating support to be capable of drilling a plurality of wells in succession over the same site and subsequently to be suitable for performing production and reconditioning operations for each of said wells. In general, the floating support has anchor means to keep it in position in spite of the effects of currents, winds, and swell. It generally also includes oil storage and processing means together with means for off-loading to off-loading tankers. Such tankers arrive at regular intervals to off-load production. Such floating supports, which are generally of the barge type, are commonly referred to by the initials "FPSO" for floating production storage off-loading. Numerous variants have been developed such as SPARs (which are long vertical floating cigar-shaped objects held in position by catenary anchoring) or indeed TLPs (tension leg platforms) which are platforms whose "legs" are anchor lines under tension, which lines generally extend vertically.

Wellheads are often distributed over an entire field and production pipes, together with water injection lines and inspection and control cables, are all placed on the sea bed to extend towards a fixed location vertically below the position of the floating support on the surface.

Some wells are thus situated vertically beneath the floating support and the insides of such wells can then be accessed directly from the surface. Under such circumstances, a wellhead fitted with its "Christmas tree" can be installed on the surface on board the floating support. It is then possible to use a derrick installed on said floating support to perform all of the drilling, production, and maintenance operations required on the well throughout its lifetime. This is referred to as a "dry" wellhead.

With SPARs and TLPs, dry wellheads are brought together in a limited zone of the platform over which the derrick is displaceable to take up a position vertically over each of the wells so as to perform drilling operations or maintenance operations on a well throughout the lifetime of the field.

Since a drilling derrick is a tall structure, possibly 60 meters (m) tall and possessing a hoisting capacity that can exceed 500 tonnes (t), the means required for moving it from one well to another and for keeping it in position during operations on any particular well give rise to structures that are complex and expensive.

In order to maintain the riser fitted with its dry wellhead in a substantially vertical position, it is appropriate to exert upward traction which can be applied either by a cable tensioning system using winches or hydraulic actuators installed on the floating support, or else by means of floats distributed along the riser and installed at various depths, or indeed by a combination of those two techniques.

French patent FR 2 754 011 describes a barge and a guidance system for a riser, in which the riser is fitted with floats.

SPARs and TLPs are likewise fitted with a multiplicity of risers supported by floats constituting cans that surround a riser coaxially, and that are held in position by guidance systems.

In FPSOs, risers reach the surface in a central cavity of the floating support that is referred to as a "wellbay". The cavity passes right through the hull vertically over a height of about 30 meters, drawing water to a depth of about 20 meters. It is generally installed on the axis of the floating support, at equal distances from its ends since this is the zone in which the amplitudes of movements and of accelerations are the smallest when the vessel is subjected to the phenomena of roll, pitch, and yaw.

The depth of water over some oil fields exceeds 1500 m, and can be as much as 2000 m to 3000 m, so the weight of risers for such depths requires vertical forces to be deployed to keep them in position that can be as great as or more than several hundreds of tonnes. Buoyancy elements of the "can" type are used which are installed at various levels along risers connecting the surface to ultragreat depths (1000 m–3000 m).

The floats concerned are of large dimensions and in particular they have a diameter in excess of 5 m, and a length of 10 m to 20 m, with each float delivering buoyancy that can be as much as 100 tonnes.

The float and the riser are subjected to the effects of swell, and of current, but since they are connected to the FPSO on the surface, they are also indirectly subjected to the effects of wind. This gives rise to lateral and vertical movements of the assembly comprising the riser, the floats, and the barge, which movements can be large, as much as several meters, particularly in a zone that is subject to swell.

To ensure that risers do not interfere with one another and do not interfere with the hull of the floating support, said risers are spaced apart from one another by several meters and also by several meters from the walls of the wellbay, which means that such wellbays can often be as much as 80 m long and 20 m wide on FPSO barges that are themselves as much as 350 m and 80 m wide, and rising by as much as 35 m above the water line. Such barges have a deadweight that can be as much as or greater than 500,000 tonnes deadweight.

These riser movements give rise to large differential forces between a riser and the guidance systems secured to the floating support.

The amplitude of the displacements and the very high level of the forces in the risers make it necessary to design guidance systems capable of withstanding not only extreme conditions, but also phenomena of fatigue and wear of the kind that can accumulate over the lifetime of such an installation, which can exceed 25 years. The present invention relates to transferring risers within the preferably central cavity, from a production position to a position in which drilling operations and heavy maintenance operations can be performed on a well, i.e. using a derrick that is fixed relative to the floating support.

Well drilling is thus performed on the main axis of the derrick through a "drilling" riser whose function is to guide the drill strings and to contain the mud returned from a well that is being drilled. Such a drilling riser is made up from unit lengths that can be as much as 50 m long, with the entire assembly being lowered step by step as the said riser is assembled. At the end of drilling, the portion of the riser corresponding to the depth of water is disconnected from the well at the sea bed, and is then taken to a parking position after its length has been shortened by removing one or two of the unit lengths. By proceeding in this way, the drilling riser remains suspended with its bottom end situated at 50 m to 100 m from the sea bed.

The production riser can then be assembled step by step in the same manner until it reaches the entrance to the well. Floats are installed on the top portion as it is put into place, and finally the bottom of the production riser is connected to the well. The well is then fitted with various items of production tubing and the "Christmas tree" of the dry wellhead is put into place.

The assembly is then transferred to a production position in which it will remain throughout the lifetime of the field, except when certain maintenance operations are performed that require said riser to be returned to the main axis of the derrick in order to perform heavy maintenance operations.

Such guidance systems generally comprise tensioning by means of cables which make transferring a riser from one position to another within a wellbay lengthy and difficult to perform, particularly with reference to displacement from the production position to the position where it lies on the axis of the derrick.

In FR 2 747 728, a floating support is described that has a rectangular or circular bay enabling a group of hydrocarbon wells to be drilled and/or operated at great depth without it being necessary to displace the derrick relative to the deck of the floating support in order to operate on a particular well selected from the group of wells, and without it being necessary to use a traveling crane to hold and displace an individual riser selected from the group of wells so as to make it possible to operate on the selected well.

In that patent FR 2 747 728, the risers are fixed at intervals to one another to a moving table that can be moved relative to the deck of the floating structure along a path such that the top ends of the respective risers can be brought successively into vertical alignment with the derrick. The bay can be in the form of an elongate rectangle and the moving table is then rectangular, extending in the longitudinal direction of the rectangular bay and movable in translation in its longitudinal direction. When the moving table is moved in translation along its longitudinal axis, all of the risers are moved simultaneously. The bay could also be circular in section with the moving table being likewise circular, having a diameter corresponding to that of the circular bay and disposed concentrically therewith, being mounted to rotate within the circular bay about the vertical axis thereof. In that case also, rotation of the circular table about its axis causes all of the risers that are attached thereto to move simultaneously.

A drawback of that system is that displacement of the moving rectangular table or rotation of the moving circular table causes all of the risers to be deflected relative to the vertical. This causes tension and/or twisting forces to be applied to the risers giving rise to a force component which, by reaction on the floating structure, gives rise to considerable levels of force between the floating support and said table, and when the table is circular, giving rise to couples tending to cause said structure to turn relative to the floating support about the axis of the circular table. Turning the circular table about its axis likewise subjects each riser to twisting forces.

FR 2 747 728 also describes a platform in which the risers are grouped together in a rectangular zone in a matrix configuration which, in plan view, comprises four rows and six columns. The derrick which supports the devices enabling well drilling, production, and reconditioning operations to be performed is mounted to move over the deck of the platform by means of a slideway system, so that the derrick can be brought selectively into vertical alignment with the top end of any one of the risers. Given that the surface wellheads situated at the top ends of the risers must have a center-to-center spacing of several meters, the derrick needs to be displaceable over a rectangular zone of relatively vast extent and the support structure connecting it to the floating support must be capable of being placed astride two longitudinal rows of wellheads so that the axis of the derrick can be placed in line with the axis of each wellhead on which it might be desired to take action. Since such a support structure should be capable of moving longitudinally and transversely relative to the axis of the floating support, it needs to be of considerable size and complexity, and it is therefore very expensive. Furthermore, when the derrick is acting on a side row, the weight of the derrick and the vertical load supported thereby can reach or exceed 3500 tonnes, so it is necessary to have large means for balancing the load on the floating support, e.g. in the form of ballast.

FR 2 747 728 also discloses a platform having a plurality of risers disposed at the internal periphery of a rectangular wellbay. A traveling crane that moves over the bay is designed to take charge of any of the risers so as to bring a selected riser from its respective support at the periphery of the bay to the center of said bay in vertical alignment with a derrick so as to enable well drilling, production, or reconditioning operations to be performed on the selected riser. Such a traveling crane must include a tensioning system capable of maintaining the riser in tension while it is being transferred from its production position to its position on the axis of the derrick where well drilling or reconditioning operations are performed. The vertical tensioning forces for supporting a deep water riser can reach or exceed 300 tonnes or even 500 tonnes or more, so the structure of the traveling crane needs to be strong since it must extend all the way across the wellbay and it must be capable of traveling beneath the structure of the derrick. The base of said derrick then needs to be enlarged considerably and reinforced so as to allow the traveling crane to pass freely.

SUMMARY OF THE INVENTION

The object of the present invention is to provide a novel type of floating support in which transferring a riser from one position to another within the wellbay is simple to perform and can be done in complete safety.

More particularly, an object of the present invention is to provide a novel type of floating support in which risers can be transferred from a production position to a drilling position within the wellbay by displacing the risers individually but without requiring an expensive infrastructure such as a traveling crane.

To do this, the present invention provides a floating support which has a preferably central cavity containing a plurality of compartments at the ends of which said risers are in their production positions, said compartments communicating with a central channel at the end of which a drilling derrick is situated, said compartments being disposed transversely relative to said central channel.

Advantageously, said compartments are essentially rectangular in longitudinal shape and they are disposed parallel to one another.

Each compartment thus contains a single riser at most, installed at the closed end of said compartment and capable of being displaced individually amongst the compartments and the central channel.

The buoyancy of the risers is preferably provided essentially or exclusively by floats without adding any additional tensioning system, in particular any system making use of cables and winches or hydraulic actuators installed on the floating support. This considerably facilitates displacement of the risers.

In a particular embodiment, said compartments are longitudinally rectilinear in shape and they are disposed parallel to one another, perpendicularly or at an angle relative to a central one of said rectilinear channels. They are preferably spaced apart from one another in regular manner.

Advantageously, said compartments and said central channel comprise a junction floor between said riser and said floating support on each rim, said junction floor defining a continuous channel of substantially constant width corresponding to a distance that is sufficient for installing a riser between its two rims and for enabling it to be displaced with the help of transfer means situated on said junction floor.

In a particular embodiment, said junction floor is situated at an intermediate level, in particular halfway, between the deck of the floating support and water level.

Preferably, the floating support of the present invention has means for transferring said risers between their production positions at the ends of the compartments, and the position of the derrick, said transfer means enabling one of said risers to be moved along said junction floor by co-operating with said risers at said junction floor.

In an embodiment, when the riser is fitted with apparatus for holding and guiding the riser in its movements relative to the floating support, said holding and guiding apparatus for the riser co-operates in particular with said riser and with said floating support at said junction floor, said transfer means co-operating with apparatus for holding and guiding the riser, said apparatus providing the junction between said riser and said floating support.

In a variant embodiment, said transfer means are stationary and secured to said floating support.

In particular, said transfer means comprise a set of winches and cables connecting said winches to said riser.

Advantageously, said transfer means comprise a carriage that is movable along said compartments and along said channel.

Also advantageously, said junction floor is fitted with guide rails enabling said transfer means or said riser to be guided, in particular if said transfer means are stationary, along or inside said compartments and said central channel, in particular where said compartments intersect said central channel.

In an embodiment, the riser is fitted with a support which provides a junction with the junction floor comprising guide elements, preferably disposed beneath said support and secured thereto, enabling said riser to be guided inside said compartments and said central channel, and where appropriate, inside said guide rails.

If the riser is fitted with holding and guidance apparatus acting relative to the floating support, it is the support providing the junction between the holding and guidance apparatus and the junction floor which has said guidance elements.

The floating support of the present invention can also include a compartment extending transversely to the central channel on the axis of the derrick, said compartments corresponding to a parking position for a riser.

In an advantageous embodiment, said risers are fitted with can-shaped floats surrounding each riser in coaxial manner about the top portion of the riser, the buoyancy of the risers being provided essentially by said floats without adding any additional tensioning system installed on the floating support.

The present invention also provides a method of transferring a riser on a floating support from a production position to a position within a drilling derrick, in which method said riser is displaced in said cavity of a floating support of the invention, as explained in the detailed description.

In an advantageous implementation, said riser is displaced by displacing said riser holding and guidance apparatus relative to the floating support, which apparatus is secured to said riser.

The apparatus for holding and guiding the riser relative to the floating support enables relative movements to be made between the floating support and the riser so as to support common loading forces corresponding to loads that can be as great as 10 tonnes, and occasional extreme forces corresponding to loads that can be as great as 100 tonnes, or even 200 tonnes or more.

In any event, the apparatus for holding and guiding the riser relative to the floating support must be capable of allowing longitudinal displacement in a substantially vertical direction of 5 meters or even more. Furthermore, for operations performed on the axis of the derrick, the riser must remain substantially in line with the axis of the derrick.

Advantageously, the apparatus for holding and guiding the riser relative to the floating support includes joint means secured to said floating support and making the following possible:

a) said riser can turn about a horizontal axis perpendicular to the longitudinal axis of said riser within a cone having a half-angle at the apex that is less than or equal to 10°, said horizontal axis and said apex of the cone being situated substantially at the center of the riser and level with the midplane of the zone in which said joint means on the longitudinal axis are situated; and b) said sliding of said riser along the longitudinal axis and said guidance of lateral displacements of said riser in a horizontal plane perpendicular to said longitudinal axis of the riser; and said joint means comprise:

friction pads presenting bearing surfaces for bearing against said riser, said pads being mounted on a pad support enabling said pads to pivot about respective axes perpendicular to said longitudinal axis of said riser; and preferably said pads co-operate with wheels so that said wheels bear against said riser and allow it to slide, and said riser bears against said pads only when said wheels are displaced under the effect of lateral displacements of said riser.

The term "longitudinal axis of the riser" is used to mean the vertical axis when the riser is in its rest position, i.e. when it is not subjected to movements associated with the sea moving.

The apparatus for holding and guiding the riser relative to the floating support is designed to support forces that vary in a horizontal plane. The wheels preferably serve to guide the riser while it is subjected to small everyday forces of about 10 tonnes, and the pads provide guidance when the riser is subjected to heavy loading under extreme conditions, and in particular forces of up to 100 tonnes.

The apparatus for holding and guiding the riser relative to the floating support can be put into place on the floating support to hold and guide one of said risers in its production position, or it can be connected to said means for transferring one of said risers from its production position to the axis of a drilling derrick. In both cases, said joint means are preferably disposed at the junction floor between said riser and said support, situated in the wall of the cavity of the floating support between the deck of the floating support and water level.

The holding and guidance apparatus can also be installed on said floating support to hold and guide one of said risers in its operating position under a derrick installed on said floating support, and more precisely on the axis of said derrick.

BRIEF DESCRIPTION OF THE DRAWINGS

Other characteristics and advantages of the present invention will appear on reading the following detailed description of various embodiments, given with reference to the following figures, in which.

DETAILED DESCRIPTION OF THE PRESENTLY PREFERRED EMBODIMENTS

Figure 1:
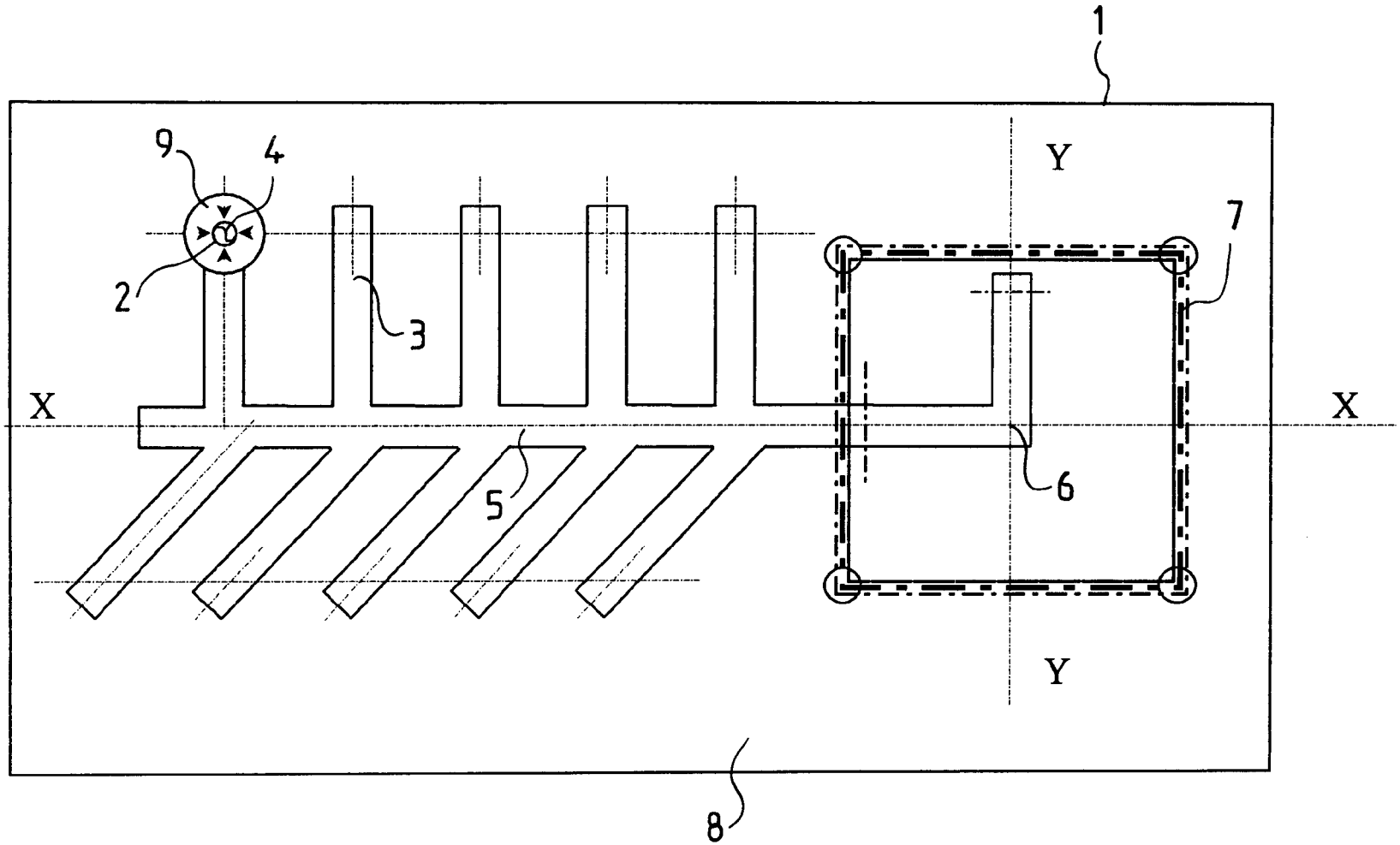
FIG. 1 is a plan view seen from above of the central cavity 1 of a floating support, and also a section view of the drilling derrick 7 at a level corresponding to +10 m relative to said junction floor 8.
Figure 5:
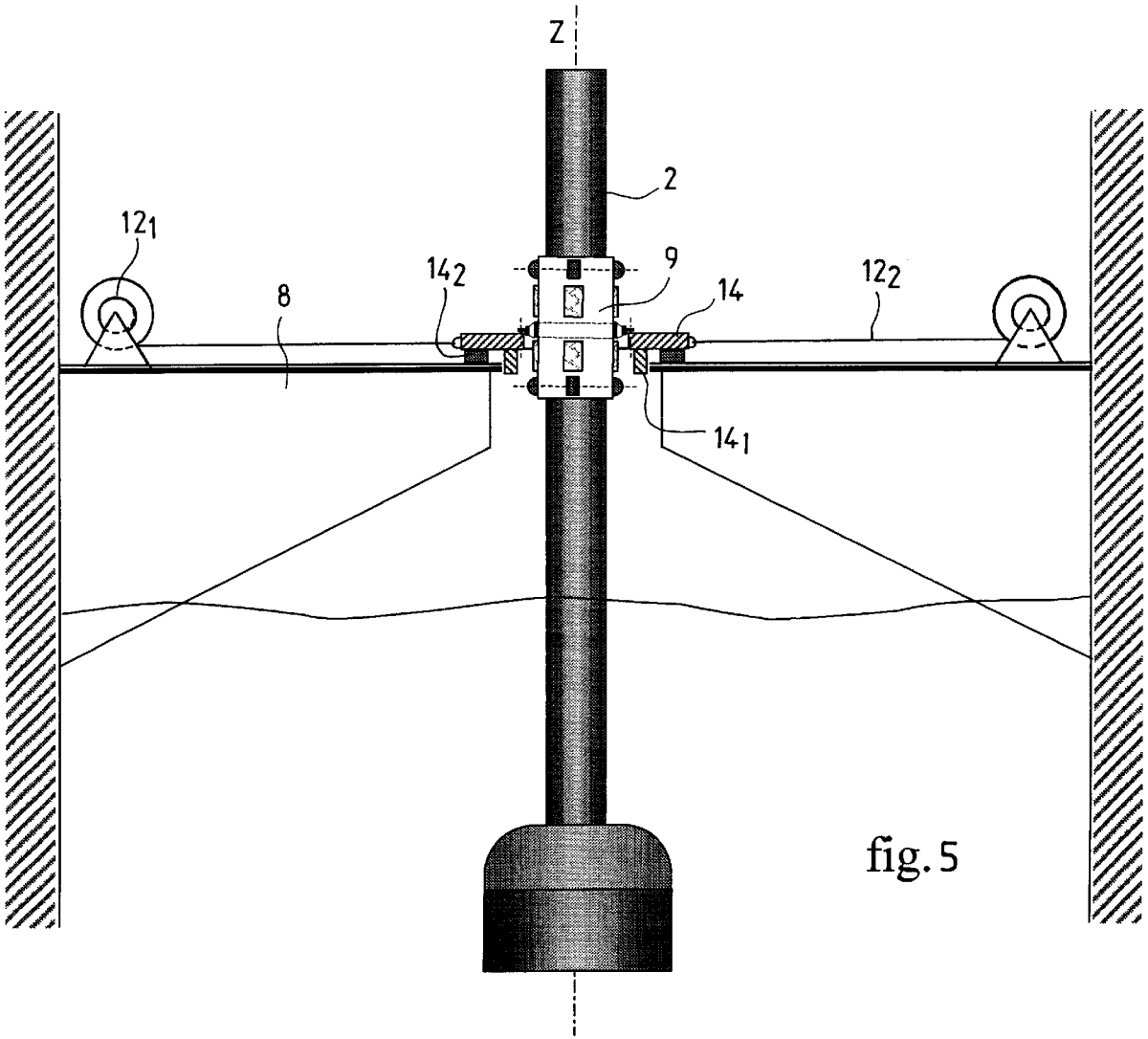
FIG. 5 is a side view of a riser being transferred in the central channel of the cavity.

FIGS. 1 and 5 show a floating support of the type comprising a rectangular central cavity 1 or "wellbay" having vertical peripheral walls 10 and within which a plurality of risers 2 can be positioned. In the invention, the rectangular central cavity 1 has a junction floor 8 that is horizontal and that provides a junction between the risers and the floating support. The junction floor 8 is situated about halfway between the water level 13 and the deck 11 of the floating support (FIG. 5). An opening in the junction floor forms a continuous channel whose two rims constituted by said floor are spaced apart by a distance that is substantially constant. This continuous channel of substantially constant width is made up of a plurality of compartments 3 of longitudinal shape and said risers 2 in their production positions 4 are located at the ends thereof, plus a central channel 5 of longitudinal shape having a drilling derrick 7 situated at one end 6 thereof, said compartments extending transversely relative to said central channel 5.

The compartments 3 are rectangular, extending parallel to one another and transversely relative to the central compartment 5, either perpendicularly thereto or at some other angle thereto, i.e. inclined relative to the longitudinal axis of the channel 5 (and thus not perpendicular relative thereto). The compartments 3 and the central channel 5 are preferably of substantially the same width.

FIG. 1 is a plan view as seen from above of the junction floor 8 containing said compartments 3 and the central channel 5. Thus, the compartments 3 and the central channel 5 form channels of substantially constant width presenting continuity between said positions of the risers in their production positions and the axis 6 of the derrick 7. The compartments 3 communicate with the central channel 5, thereby enabling a riser to be moved over the junction floor 8 between its production position 4 and the position of the axis 6 of the derrick. Ten production positions 4 are shown, but only one of them is shown provided with its riser 2 fitted with a guidance apparatus 9 secured to the junction floor 8.

In FIG. 1, there can be seen ten locations 4 for production risers 2, the rectangular compartments 3 being spaced apart from each other by about 5 m, and their ends being situated at 5 m from the vertical peripheral wall 10 of the central cavity 1. The length of said rectangular compartments 3 is about 6.5 m to the axis of the channel 5, and the width thereof is about 1 m to 1.5 m. In the same manner, said central channel 5 is of a width that is substantially identical, i.e. about 1 m to 1.5 m, and its length is a function of the number of wellheads, and constitutes about 30 m in the example shown in FIG. 1.

Figure 3:
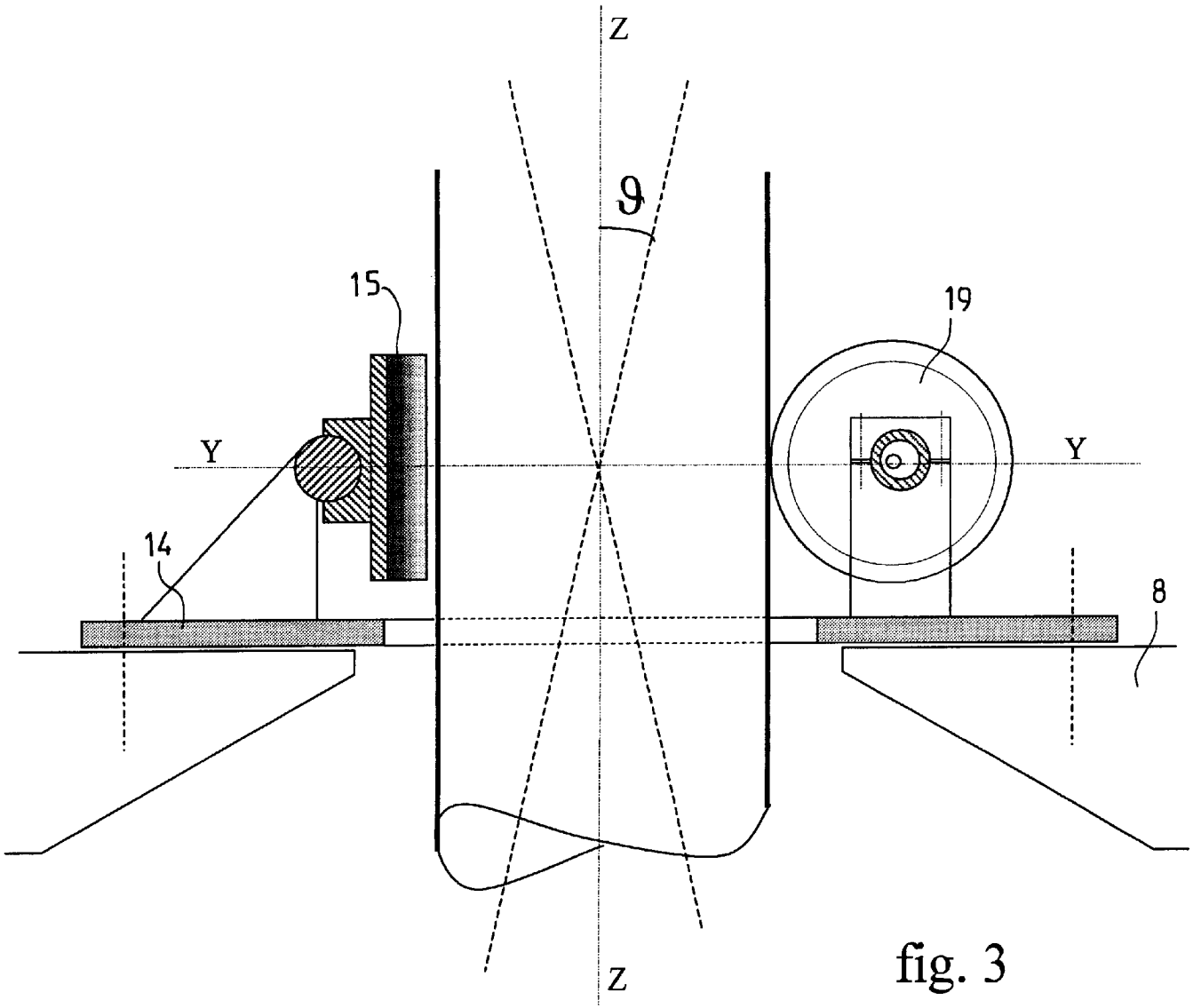
FIG. 3 is a side view of a riser fitted with apparatus for holding and guiding the riser relative to the floating support 9, and including a plurality of wheels 19 and of pads 15 installed in alternation around said riser 2.
Figure 4:
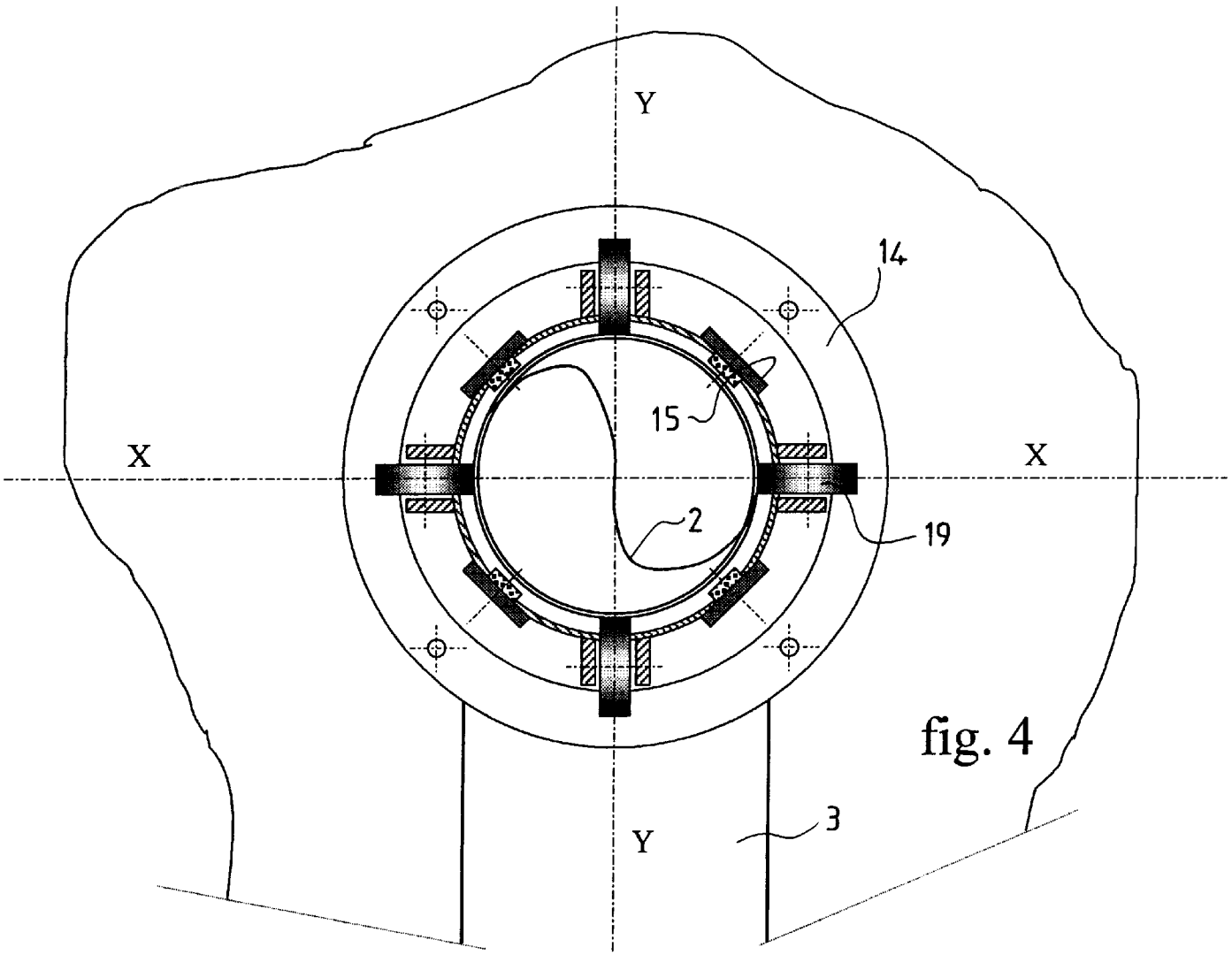
FIG. 4 is a plan view of apparatus 9 for holding and guiding a riser of the type shown in FIG. 3, shown resting on the junction plane 8 where there can be seen a compartment 3 forming a channel enabling the assembly comprising the riser and the apparatus for holding and guiding it to be displaced to the axis of the derrick.

A riser 2 in the production position 4 is situated at the end of a compartment 3. The riser 2 is fitted with holding and guidance apparatus 9 constituted by joint means as shown in FIGS. 3, 4, and 5, in particular relative to the plane P0. This holding and guidance apparatus 9 for movements of the riser 2 relative to the floating support enables the riser to move vertically and laterally, since it includes means for rotation about an axis XX'/YY' perpendicular to the longitudinal axis ZZ' of the riser, and means enabling the riser to slide along its longitudinal axis ZZ'.

Figure 2:
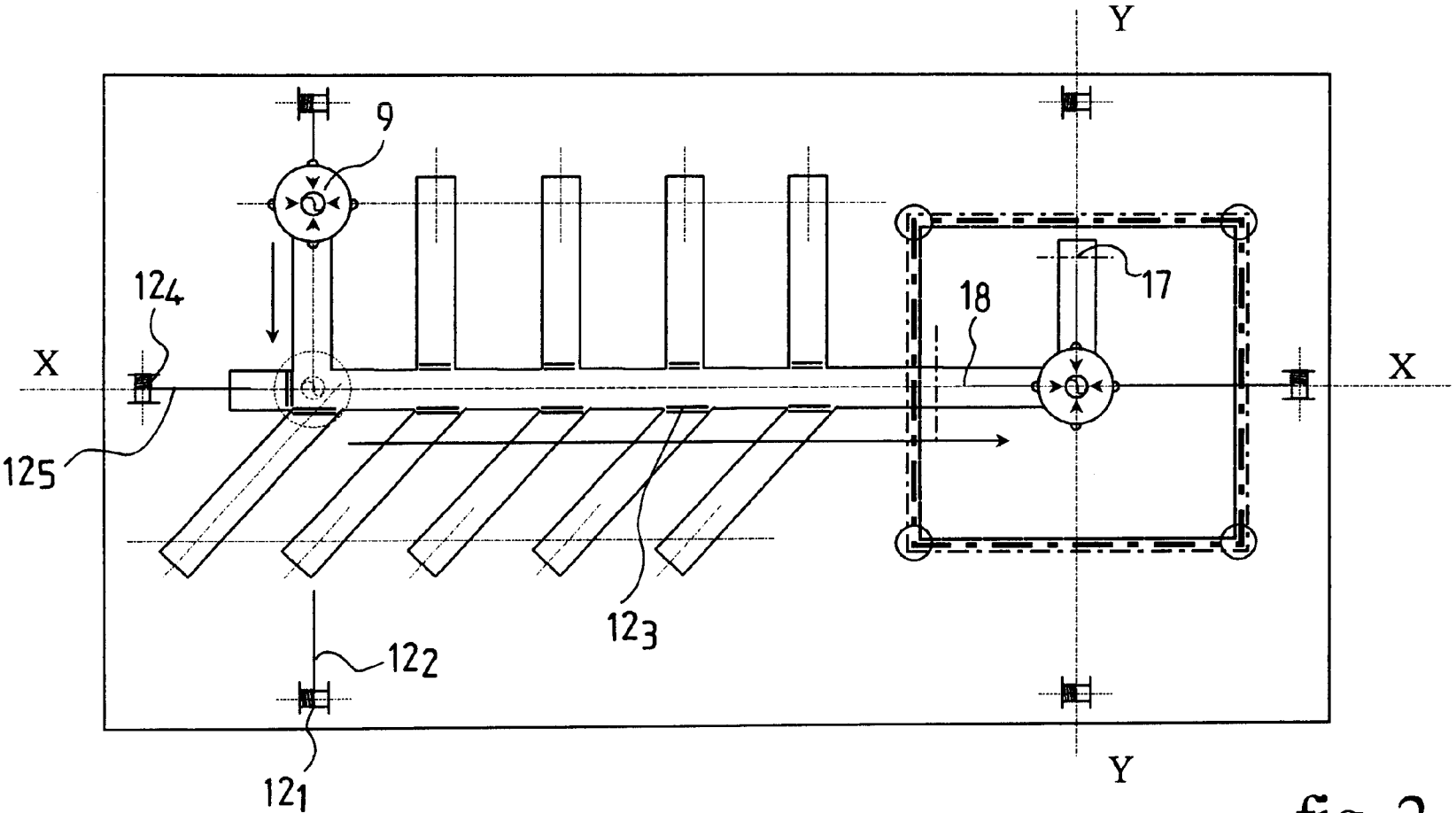
FIG. 2 is a plan view similar to FIG. 1, further showing transfer means 12 for a riser, to transfer it from its production position 4 to the axis of the drilling derrick 6.

In FIGS. 1 and 2, the compartments are disposed perpendicularly to the channel on one rim of the channel and at an angle inclined at about 45° relative to the axis XX' of the channel on the other rim of the channel.

In FIG. 2, the junction floor 8 also includes means 12 for transferring the riser 2 and its guidance apparatus 9, which means are constituted by winches $\mathbf{12}_1$ connected by cables $\mathbf{12}_2$ to the holding and guidance apparatus 9 which moves merely in sliding over the junction floor 8 while being guided in the compartments and the channel 3 by rails $\mathbf{12}_3$. These two winches enable the assembly comprising the riser and the guidance apparatus 9 to be moved between the production position 4 and the axis of the central channel 5. The rails $\mathbf{12}_3$ facilitate passing the apparatus 9 over adjacent compartments from the starting position all the way to the axis 16 of the derrick. Once the riser and its guidance apparatus 9 are in position in the central channel 5, winches $\mathbf{12}_4$ are connected to a support 14 of the guidance apparatus 9 by two cables $\mathbf{12}_5$ and the cables $\mathbf{12}_2$ of the winches $\mathbf{12}_1$ are then disconnected. By acting on the winches $\mathbf{12}_4$, the assembly comprising the riser and the guidance apparatus 9 is then transferred from the central position 5 to the axis 16 of the derrick.

FIG. 2 shows the rails $\mathbf{12}_3$ which follow the compartments 3 and the channel 5 along the entire path between the production position 4 and the position of the axis 6 of the derrick, such that the compartments 3 are crossed over where they intersect said central channel 5 by means of said rails $\mathbf{12}_3$, which rails can nevertheless be removable.

It will be understood that from a functional point of view, it is the guide rails $\mathbf{12}_3$ of the transfer means 12 running along said compartments 3 and along the channel 5 that need to form a channel of substantially constant width. When such rails $\mathbf{12}_3$ are provided, the compartments 3 and the channel 5 together with the junction floor 8 need not themselves define a channel of substantially constant width.

As shown in FIGS. 3 to 5, the apparatus 9 for holding and guiding the riser 2 rests on the junction floor 8. The riser 2 can thus be transferred from its production position 4 to its position 6 under the derrick 7 by transferring a holding and guidance apparatus 9 securely fitted to the riser.

FIG. 3 shows an embodiment of the guidance apparatus 9 in which the pads 15 and the wheels 19 cooperate in the manner described above. This guidance apparatus 9 makes the following possible:

a) the riser can move parallel to its longitudinal axis ZZ';

b) angular movements are possible about axes XX' and YY' in a horizontal plane within a cone whose half-angle at the apex is θ, with the half-angle of said cone being less than 10° in the invention; and c) very limited lateral displacements in the plane of the axes XX' and YY'.

The holding and guidance apparatus 9 shown in FIGS. 3 and 4 is constituted by a plurality of wheels 19 and pads 15 installed in alternation around said riser, having at least three wheels and at least three pads disposed regularly around said riser.

The wheels are in contact with the riser 2. When forces become large, the wheels 19 retract, and the pads then come directly into contact with the wall of the riser. Forces are then transmitted between the riser and the junction floor in a manner that is substantially symmetrical about the plane XX'/YY' regardless of the value of the angle θ formed by the axis of the riser with the vertical.

FIG. 4 is a plan view relating to a holding and guidance apparatus 9 similar to that of FIG. 3, showing the apparatus 9 for guiding the riser 2 in its position corresponding to the production position 4 and resting on the junction floor 8. Said junction floor 8 forms a compartment forming a channel enabling the assembly comprising the riser 2 and the guidance apparatus 9 to be displaced towards the axis 6 of the derrick 7. The guidance apparatus comprises:

four wheels 19 in contact with the riser; and four pads 15 set back a little from the riser.

The guidance apparatus 9 is secured to the junction floor 8 via a support 14 which can be released from the floor when the apparatus is transferred to some other position.

As mentioned above, the guidance apparatus 9 can be transferred together with the riser 2 towards the axis of the derrick.

However said guidance apparatus 9 can equally well be left in place. In which case it needs to be openable so as to release the riser 2 which is then taken over by a second guidance apparatus that performs the same function, but with the difference that since the transfer operation is of short duration and can be performed preferably in calm weather, said guidance apparatus 9 can be considerably simplified.

In FIG. 5, the guidance apparatus 9 has a support 14 in the form of a washer which rests on the junction floor 8 via pads $\mathbf{14}_2$ that slide on said floor 8 to transfer the riser into the central channel 5 when the winches (not shown) $\mathbf{12}_4$ and the cables $\mathbf{12}_5$ are put into operation. Tubular guide elements $\mathbf{14}_1$ disposed beneath the support 14 and secured thereto serve to guide the assembly along the channel 5 formed by the rims of the junction floor 8.

Transfer from the production position 4 to the axis 6 of the derrick 7 is described above for winch type means guided in the channel 3 of the junction floor 8. A similar result can be obtained by a carriage driven on rails e.g. having wheels actuated by an engine or by an electric moor associated with batteries, or indeed by stepper advance systems based on the use of hydraulic actuators. Said carriage is advantageously fitted with an arm having an opening clamp at the end of which a guidance apparatus 9 as described in FIG. 3 serves to take hold of the riser 2 in its production position (or "slot" position) 4 at the time a permanent guidance apparatus 9 opens to enable it to be transferred towards the axis 6 of the drilling derrick 7.

While drilling the well, the riser is a riser specially designed for such drilling. It lies on the axis of the derrick and it is held on said axis throughout the duration of drilling operations that can last for more than 1 month.

At the end of drilling, the drilling riser is disconnected from the wellhead and is then displaced sideways to a parking position 17 while maintaining, during said transfer, guidance $\mathbf{12}_3$ by means of the junction floor 8. In position 17, it is then held suspended by means (not shown) such as cables connected to the structure of the derrick or it rests on a support (not shown) secured to the wall of the cavity. To prevent the bottom portion of the drilling riser interfering with the sea bed or with structures on the sea bed, it is appropriate to take the precaution of reducing the length of the riser by 50 meters to 100 meters by removing one or two unit lengths of drill string. By operating in this way, as soon as the operations of installing the production riser and of completing the well have been terminated, said production riser can be transferred to its production position and with the axis of the derrick being freed, it is possible to reinstall the drilling riser at once to start drilling the next well. This saves operating time that would otherwise correspond to raising and then lowering the full length of the drilling riser.

In a preferred version of the invention, the derrick has a second working location 18 situated within the load carrying structure of said derrick. The term "working" location is used herein to mean a location having installed vertically thereabove handling means that enable operations to be performed on production risers, for example operations concerned with maintaining the "Christmas tree" or with maintaining the inside of the well at various depths. Thus, vertically above this location, there are installed hoist means and handling means of a capacity that is generally smaller than that of the corresponding means which are installed on the axis of the derrick. Thus, hoist means are installed on the axis of the derrick that can carry loads of 500 tonnes on-hook, and the vertical stroke of the hook can be as much as 50 meters, whereas on the secondary working axis 18, a hoisting capacity is installed that is limited, e.g. to 100 tonnes, and with a hook stroke that is likewise limited, e.g. to 12 meters vertically. This makes it possible to work with drilling a well on the axis 16 of the derrick and simultaneously to work in position 18 with maintaining another well, by making use of the derrick structure to support simultaneously the necessary loads and to handle the necessary tools.

What is claimed is:

1. A floating support of the type having a cavity within which a plurality of risers can be positioned, wherein the cavity has a plurality of compartments at the ends of which said risers are in a production position, said compartments communicating with a central channel at the end of which there is situated a drilling derrick, said compartments being disposed transversely relative to said central channel, each said compartment comprising no more than one said riser, and said floating support including transfer means for transferring said risers between their production positions at the ends of the compartments and the position of the derrick.

2. A floating support according to claim 1, wherein said compartments have two rims and said compartments and said central channel comprise a junction floor between said riser and said floating support on each said rim, said junction floor defining a continuous channel of substantially constant width, and said transfer means enables one of said risers to be moved along said junction floor in co-operation with said risers at said junction floor.

3. A floating support according to claim 2, wherein said transfer means co-operate with apparatus for holding and guiding the riser, said apparatus providing the junction between said riser and said floating support.

4. A floating support according to claim 3, wherein said holding and guiding apparatus for said riser is fitted with a support joining it to the junction floor, said support having guide elements enabling said riser to be guided within said compartments and said central channel.

5. A floating support according to claim 2, wherein said junction floor is situated on the wall of the cavity at a level intermediate between the deck of the floating support and water level.

6. A floating support according to claim 2, wherein said junction floor is fitted with guide rails enabling said transfer means or said riser to be guided along or within said compartments and said central channel.

7. A floating support according to claim 2, wherein the riser is fitted with a support joining it to the junction floor, said support having guide elements enabling said riser to be guided within said compartments and said central channel.

8. A floating support according to claim 1, wherein said transfer means are fixed and secured to said floating support.

9. A floating support according to claim 8, wherein said transfer means comprise a set of winches and of cables connecting said winches to said riser.

10. A floating support according to claim 1, wherein said transfer means comprise a carriage that is movable along said compartments and along said central channel.

11. A floating support according to claim 1, having a compartment extending transversely to the central channel on the axis of the derrick, said compartment corresponding to a parking position for a riser.

12. A floating support according to claim 1, wherein the derrick has a second working location situated within the structure of said derrick.

13. A floating support according to claim 1, wherein said compartments are of longitudinal rectilinear shape and are disposed parallel to one another, and at an angle relative to said rectilinear central channel.

14. A floating support according to claim 1, wherein said risers are fitted with floats, the buoyancy of the risers being provided essentially by said floats without help from an additional tensioning system installed on the floating support.

15. A floating support according to claim 14, wherein said floats are in the form of cans surrounding each riser coaxially over the upper portion thereof.

16. A method of transferring a riser on a floating support from its production position to its position within a drilling derrick, wherein said riser is displaced in said cavity of a floating support according to claim 1.

17. A method according to claim 16, wherein said riser is displaced by moving said apparatus for holding and guiding the riser relative to the floating support, which is itself secured to said riser.

18. A floating support according to claim 1, wherein said compartments are of longitudinal rectilinear shape and are disposed parallel to one another, and perpendicularly to said rectilinear central channel.

19. A floating support of the type having a cavity within which a plurality of risers can be positioned, wherein the cavity has a plurality of compartments at the ends of which said risers are in a production position, said compartments communicating with a central channel at the end of which there is situated a drilling derrick, said compartments being disposed transversely relative to said central channel; wherein said compartments and said central channel comprise a junction floor between said riser and said floating support on each rim, said junction floor defining a continuous channel of substantially constant width; wherein said junction floor is situated on the wall of the cavity at a level intermediate between the deck of the floating support and water level.

20. A floating support of the type having a cavity within which a plurality of risers can be positioned, wherein the cavity has a plurality of compartments at the ends of which said risers are in a production position, said compartments communicating with a central channel at the end of which there is situated a drilling derrick, said compartments being disposed transversely relative to said central channel; and further comprising transfer means for transferring said risers between their production positions at the ends of the compartments and the position of the derrick, said transfer means being fixed and secured to said floating support, and including a set of winches and of cables connecting said winches to said riser.

21. A floating support of the type having a cavity within which a plurality of risers can be positioned, wherein the cavity has a plurality of compartments at the ends of which said risers are in a production position, said compartments communicating with a central channel at the end of which there is situated a drilling derrick, said compartments being disposed transversely relative to said central channel; and further comprising transfer means for transferring said risers between their production positions at the ends of the compartments and the position of the derrick, said transfer means including a carriage that is movable along said compartments and along said central channel.

22. A floating support of the type having a cavity within which a plurality of risers can be positioned, wherein the cavity has a plurality of compartments at the ends of which said risers are in a production position, said compartments communicating with a central channel at the end of which there is situated a drilling derrick, said compartments being disposed transversely relative to said central channel; and wherein said derrick has a second working location situated within the structure of said derrick.

23. A floating support of the type having a cavity within which a plurality of risers can be positioned, wherein the cavity has a plurality of compartments at the ends of which said risers are in a production position, said compartments communicating with a central channel at the end of which there is situated a drilling derrick, said compartments being disposed transversely relative to said central channel; wherein said risers are fitted with floats in the form of cans surrounding each riser coaxially over the upper portion thereof, the buoyancy of the risers being provided essentially by said floats without help from an additional tensioning system installed on the floating support.

* * * * *